United States Patent [19]

Gaibler

[11] 4,406,575

[45] Sep. 27, 1983

[54] QUICK-MOUNT SIDE SHIFTER FOR USE ON A FORKLIFT TRUCK

[75] Inventor: Dennis W. Gaibler, Gresham, Oreg.

[73] Assignee: Cascade Corporation, Portland, Oreg.

[21] Appl. No.: 307,886

[22] Filed: Oct. 2, 1981

[51] Int. Cl.[3] ..... B66F 9/14

[52] U.S. Cl. ..... 414/667; 414/785

[58] Field of Search ..... 414/662–664, 414/667, 671, 785

[56] References Cited

U.S. PATENT DOCUMENTS 3,460,700 8/1969 Kroupa ..... 414/667

4,165,008 8/1979 Faust et al. ..... 414/667

FOREIGN PATENT DOCUMENTS 2030542 4/1980 United Kingdom ..... 414/667

*Primary Examiner*—Robert G. Sheridan

*Attorney, Agent, or Firm*—Chernoff, Vilhauer, McClung, Birdwell & Stenzel

[57] ABSTRACT

A side shifter having a quick-mounting anchor bracket for mounting on a conventional hook-type lift truck carriage without the need for welding of any side shifter components, such as a hydraulic ram anchor, to the lift truck carriage. The side shifter features alternative upper and lower hydraulic ram anchors and interlocking relatively movable components which are prevented from disassembly when the side shifter is detached from the lift truck carriage. Friction-reducing bushings for accommodating the transverse sliding motion of the side shifter are engaged with the quick-mounting anchor bracket in such a way so as to prevent not only transverse motion but also upward motion of the bushings which might otherwise occur under the influence of the load moment. The side shifter features lower hook assemblies capable of supporting the side shifter at an elevated position when detached from the lift truck carriage, and capable of exceptionally fine vertical adjustment.

10 Claims, 9 Drawing Figures

FIG. 7
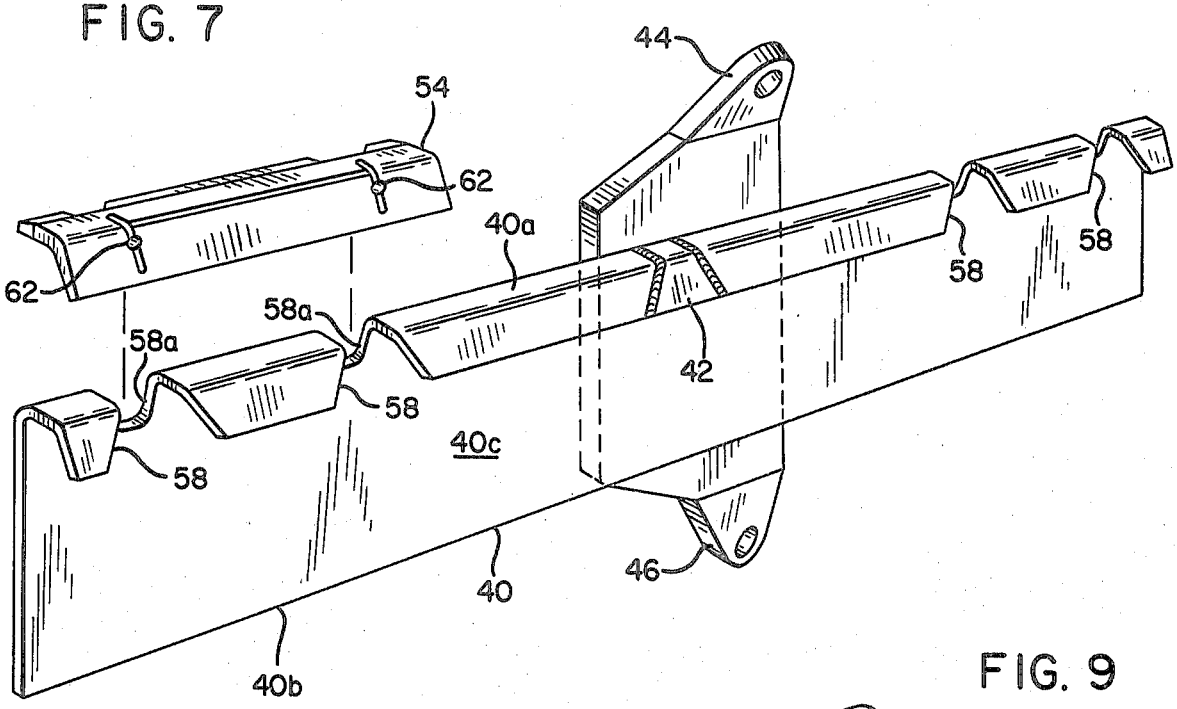
FIG. 9
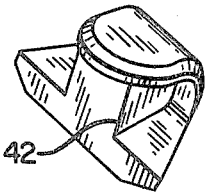
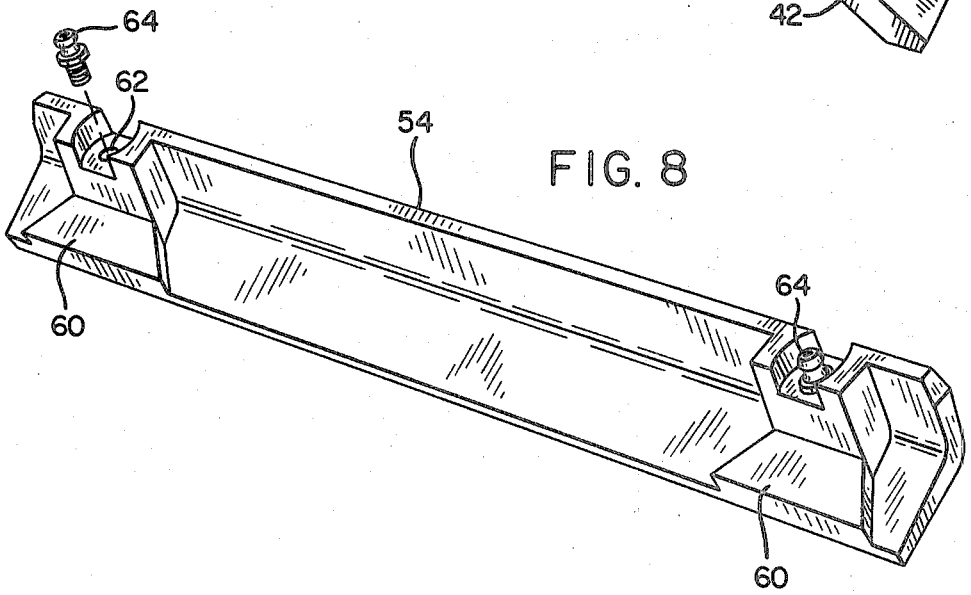
FIG. 8

QUICK-MOUNT SIDE SHIFTER FOR USE ON A FORKLIFT TRUCK

BACKGROUND OF THE INVENTION

This invention relates to improvements in quick-mount side shifters for mounting load-handling attachments on the carriage of a forklift truck.

The use of side shifters interposed structurally between a conventional lift truck load carriage and a load-handling attachment, to enable selective transverse shifting of the load-handling attachment relative to the lift truck carriage, is well-known. Usually the installation of such side shifters requires substantial time and effort on the part of the lift truck dealer or user, primarily due to the requirement for welding an anchor to the carriage of the lift truck to which is attached one end of the side shifter's hydraulic ram assembly. Such welded anchors are shown, for example, in U.S. Pat. Nos. 3,460,700 and 4,165,008 respectively. Some lift trucks can accommodate the placement of the side shifter hydraulic ram assembly in a position between the upper and lower attachment mounting bars of the carriage as shown in the aforementioned U.S. Pat. No. 4,165,008, which position is desirable because of the protection for the ram assembly afforded thereby. However other forklift trucks may have structures or components which interfere with the placement of the ram assembly in this area, and in such cases an upper placement of the ram assembly, above the upper attachment mounting bar as shown in U.S. Pat. No. 3,460,700, is required. The person installing the side shifter must be aware of these potential problems and exercise appropriate care in the location and orientation of the ram assembly anchor prior to welding it to the lift truck carriage. Moreover, after such anchor has been properly attached to the carriage, friction-reducing bushings or shoes must be mounted on the top of the upper attachment mounting bar of the carriage, the side shifter mounted on the carriage and the side shifter's hydrulic ram connected to the aforementioned ram anchor, all of which is time-consuming. In addition, in applications such as lift truck rental fleets, the side shifter may need to be repeatedly demounted for replacement by other load-handling attachments, depending upon the particular needs of the users, which is also a time-consuming process.

To solve the aforementioned mounting and demounting difficulties with side shifters, several types of "quick-mount" side shifters have been developed in the past. One of these is shown in British patent application publication No. 2,030,542, and features a quick-mounting anchor bracket which attaches to the upper attachment mounting bar of the lift truck carriage in substantially the same removable manner that a lift truck attachment would, and without the need for any welding. Such quick-mounting anchor bracket engages the upper teeth of the mounting bar so as to resist transverse motion with respect thereto, and the side shifter's sliding frame is supportably and slidably mounted atop the anchor bracket by means of an elongate, downwardly-opening hook or guide, with a friction-reducing bushing or shoe interposed between the anchor bracket and hook to facilitate relative sliding between the side shifter frame and the anchor bracket. Other quick-mount side shifters, used principally in Europe, have been sold under the trademarks CASCADE, TECTOR, BOLZONI, MEYER, KAUP and MANDIGERS respectively.

Most of these prior quick-mount side shifters recognize the desirability of locating the side shifter hydraulic ram assembly in a position below the upper attachment mounting bar of the carriage so as to protect the ram assembly. However, in recognition of the interference problems posed by placement of the ram assembly in such location on some lift trucks, such side shifters generally provide a substantial forward clearance between the front of the lift truck carriage and the front of the side shifter to provide sufficient room for the ram assembly in any lift truck upon which the side shifter might be mounted. Unfortunately this approach tends to maximize the distance by which the front of the side shifter, and therefore the load-handling attachment, protrudes forwardly of the front axle of a counterbalanced lift truck, thereby tending to reduce the load-carrying capacity of the lift truck which is a serious disadvantage.

The most economical and reliable slide structure utilized by previous quick-mount side shifters is of the general type shown in the aforementioned British patent application publication, wherein the side shifter frame utilizes a downwardly-opening hook which fits supportably and slidably over the top of the anchor bracket with a friction-reducing bushing therebetween. The problem with most of such structures in the past has been that there is no way to keep the anchor bracket, friction-reducing bushing and side shifter frame in a fully-assembled condition when the side shifter is not mounted on a lift track carriage. This problem necessitates preassembly of the side shifter by the installer prior to mounting, detracting from the hoped-for facility of installation which is the objective of such a structure. One previous structure, a CASCADE quick-mount side shifter, utilizes a quick-mounting anchor bracket which extends substantially the full vertical height of the side shifter frame. Because of its substantial vertical dimension, such anchor bracket is prevented from disassembly from the side shifter frame, even in an unmounted condition, by means of removable connectors connecting the bottom of the anchor bracket to the bottom of the side shifter frame. However the substantial vertical dimension of the anchor bracket tends to maximize the forward protrusion of the side shifter, thereby detracting from the load-carrying capacity of the lift truck. Certain other types of previous quick-mount side shifters, such as the Kaup and Mandigers side shifters, do not utilize the economical and reliable downwardly-opening hook-type slide structure previously described, and therefore are not faced with the problem of preventing disassembly of the anchor bracket from the side shifter frame when the side shifter is not mounted on the carriage.

Another common problem of previous side shifters employing the downwardly-opening hook-type slide structure is that the moment imposed on the slide structure by the weight of the load tends to cause the friction-reducing bushing or shoe beneath the hook to ride upwardly with respect to its underlying support, thereby causing the bushing ultimately to be displaced from its proper position with resultant malfunction of the bushing and damage thereto. Although, in the past, such bushings have included retainer structures for preventing the bushings from being displaced transversely in the direction of the sliding motion, no structure has been provided to retain such bushings positively against upward displacement, and thus the aforementioned problem has remained.

In the use of previous quick-mount side shifters, particularly in connection with lift truck rental fleets where rapid demounting of a side shifter to accommodate the needs of the next user may be required, there has usually been some problem with respect to how to quickly and easily arrange some elevated support for the side shifter and its attachment so that the lift truck carriage may be detached and lowered from under the side shifter. Usually it is necessary to search for blocks of wood or similar supports to hold the side shifter a spaced distance above the ground in order to accomplish this. No means integral to a quick-mount side shifter have previously been provided for this purpose.

In addition, a previous problem with all side shifters, whether of the quick-mount or more conventional type, has existed with respect to the lower hook assemblies which slidably attach the bottom of the side shifter frame to the lower attachment mounting bar of the lift truck carriage. Proper vertical adjustment of these lower hooks is critical, because if they are too tight they will resist the transverse sliding motion necessary for proper operation of the side shifter, and if too loose they can become disengaged causing inadvertent detachment of the side shifter from the lift truck carriage resulting in injury to a load or to nearby workmen. An improvement in the fineness of the adjustability of the lower hook assembly is therefore needed for all side shifters.

SUMMARY OF THE INVENTION

The present invention is directed to an improved quick-mount side shifter having features which overcome all of the above-described disadvantages of prior quick-mount side shifters.

The prior problem of how to provide for placement of the side shifter ram assembly below the upper attachment mounting bar of the carriage, without thereby also increasing unduly the forward protrusion of the side shifter to allow sufficient clearance for all of the different types of lift trucks upon which the side shifter might be mounted, is solved by providing the side shifter with hydraulic ram anchors which permit alternative placement of the ram assembly in either a high or a low position. With this arrangement, the forward protrusion of the side shifter can be minimized while retaining the desirable low mounting of the ram assembly for those lift trucks having adequate clearance in such location; whereas, for those lift trucks which do not have adequate clearance in such location, the alternative ram anchors allow the installer quickly and easily to choose a high location for the ram assembly, i.e. above the upper attachment mounting bar of the carriage. In both cases, the load-carrying capacity of the lift truck is maximized by the fact that the forward clearance and protrusion of the side shifter is minimized. It will be recognized that this alternative high-low ram placement capability is rendered feasible by the quick-mounting characteristics of the side shifter, which permit the quick-mounting anchor bracket to be provided with multiple alternative ram anchors without in any way adding to the installation effort.

Although the quick-mount side shifter of the present invention utilizes the economical and highly reliable downwardly-opening hook-type structure to provide the transverse sliding support for the side shifter frame, and although the anchor bracket of the present invention is of the more abbreviated style having a vertical dimension substantially less than that of the side shifter frame so as to minimize the forward protrusion thereof, the side shifter frame, anchor bracket and friction-reducing bushings interposed therebetween are nevertheless restrained against disassembly from one another while the side shifter is unmounted by means of a removable sliding interlock structure between the side shifter frame and the quick-mounting anchor bracket, thereby eliminating the extra assembly effort otherwise required with previous quick-mount side shifters employing such downwardly-opening hook-type structures.

The aforementioned previous tendency of the friction-reducing bushings, utilized in slide structures of the downwardly-opening hook type, to ride upwardly under the influence of the load moment has been overcome in the present invention by a mating retainer structure interconnecting the bushing and the quick-mounting anchor bracket which not only prevents relative transverse motion between the two but also prevents upward movement of the bushing relative to the quick-mounting anchor bracket.

The previous problem of how to support the quick-mount side shifter in spaced relationship to the ground while the lift truck carriage is being detached therefrom, without the need for securing supports from some other source, is eliminated by enabling the lower hooks of the side shifter to be pivoted downwardly and locked when disengaged from the lift truck carriage so as to perform a second function of vertical support of the side shifter. Such function requires that the hooks, when pivoted downwardly, protrude downwardly from the bottom of the side shifter frame a greater distance than their upward protrusion therefrom when engaging the lift truck carriage.

The previous difficulty of insufficient fine adjustability of the lower hooks of side shifters has been eliminated in the present invention by providing vertical interlocking serrations between the hooks and side shifter frame, together with inclined guideways for the hooks which are oriented transversely at an angle with respect to the vertical serrations and thereby permit vertical adjustment of the hooks in increments which are less than the incremental spaces between adjacent serrations.

Accordingly, it is a primary objective of the present invention to provide a quick-mount side shifter having provision for selective alternative placement of the side shifter hydraulic ram assembly in different vertically-spaced positions so as to provide the capability for low or high placement of the ram while minimizing the forward protrusion of the side shifter.

It is a further objective of the present invention to provide a quick-mount side shifter, of the type having an abbreviated quick-mounting anchor bracket of substantially less vertical dimension than that of the side shifter frame and a slide structure comprising a downwardly-opening hook, with an interlocking member between the quick-mounting anchor bracket and side shifter frame which prevents disassembly thereof when the side shifter is not mounted on a lift truck carriage.

It is a further objective of the present invention to provide a quick-mount side shifter having friction-reducing slide bushings which are positively restrained against both transverse and upward movement with respect to the quick-mounting anchor bracket.

It is a further objective of the present invention to provide a quick-mount side shifter having lower hooks capable of performing a second function of supporting the side shifter a spaced distance above the ground when the side shifter is demounted from a lift truck carriage.

It is a further objective of the present invention to provide a side shifter with lower hook assemblies having exceptionally fine vertical adjustability.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 7 is an exploded perspective view of the quick-mounting anchor bracket and one of its related friction-reducing bushings.

FIG. 8 is an enlarged perspective view of the friction-reducing bushing shown in FIG. 7.

FIG. 9 is an enlarged perspective view of a lug member utilized in the quick-mounting anchor bracket of FIG. 7 to prevent transverse movement thereof relative to the lift truck carriage.

DESCRIPTION OF THE PREFERRED EMBODIMENT

Figure 1:
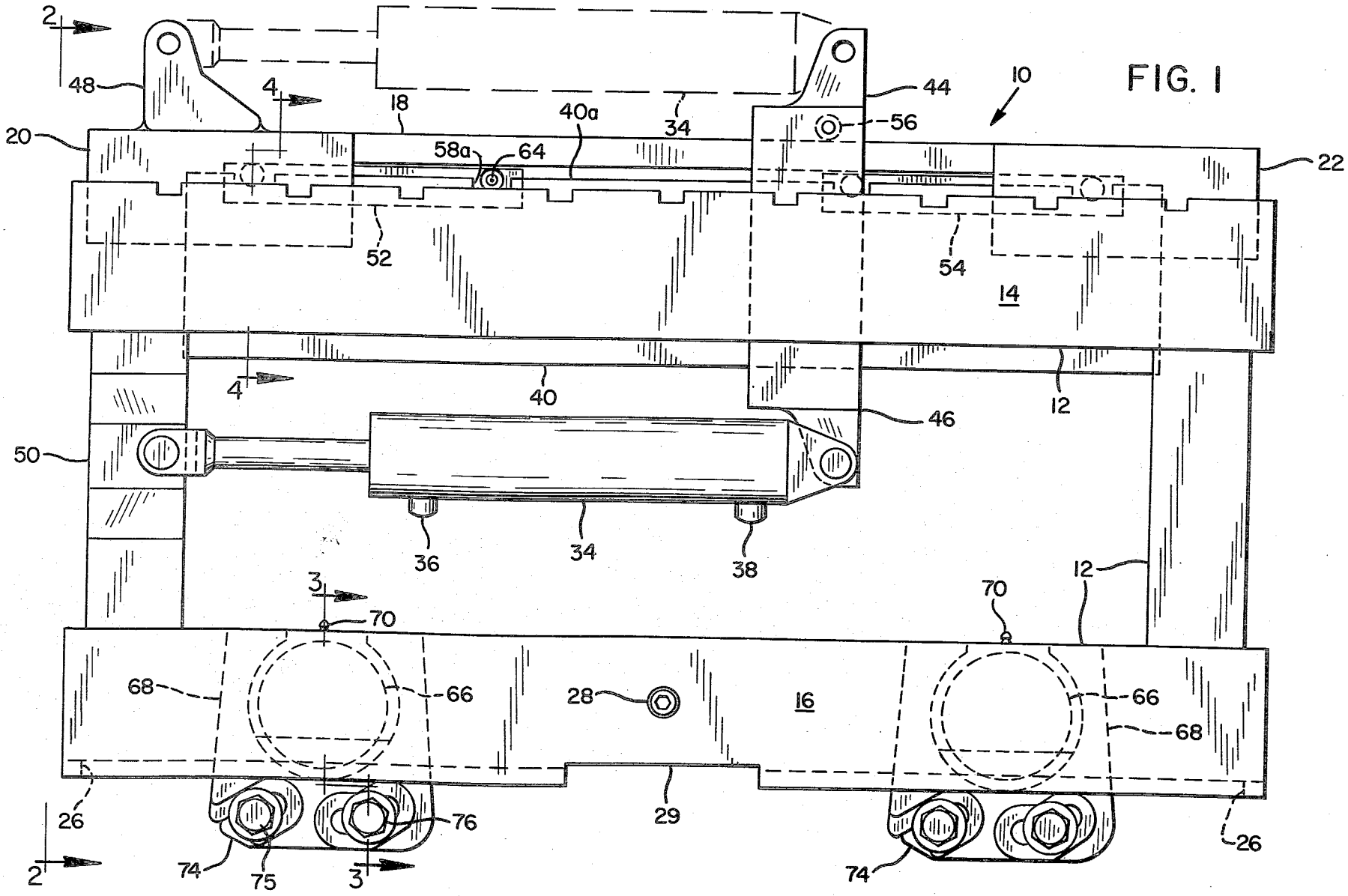
FIG. 1 is a front view of an exemplary preferred embodiment of the quick-mount side shifter of the present invention, illustrating the alternative, vertically-spaced positions for the side shifter hydraulic ram assembly.
Figure 2:
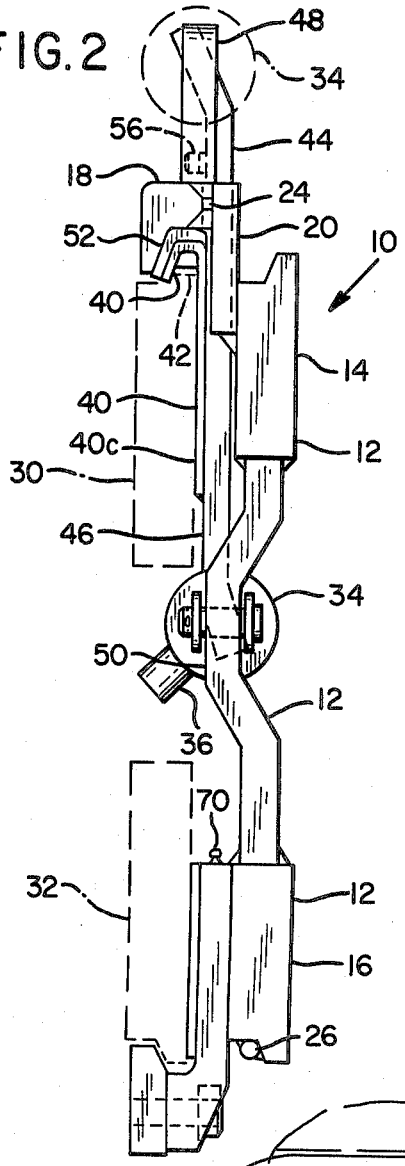
FIG. 2 is an end view of the side shifter taken along line 2—2 of FIG. 1.
Figure 4:
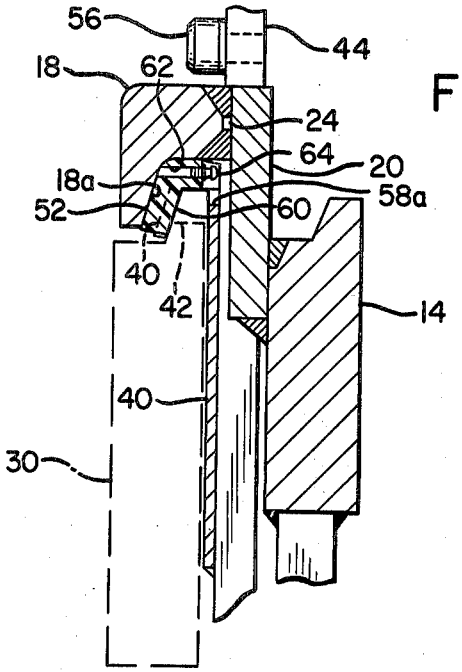
FIG. 4 is an enlarged cross-sectional view of the upper portion of the side shifter, taken along line 4—4 of FIG. 1.

The preferred quick-mount side shifter of the present invention, designated generally as 10 in FIGS. 1 and 2, comprises a side shifter frame 12 having forwardly-facing mounting bars 14 and 16 respectively upon which a load-handling attachment may be mounted. The side shifter frame 12 also includes a rearwardly-extending, downwardly-opening elongate hook 18 connected by a pair of transversely-spaced plates 20 and 22 to the rear side of the mounting bar 14 of the side shifter frame 12. As seen in FIGS. 2 and 4, plates 20 and 22, together with a respective spacer 24 coextensive with each plate 20, 22, hold the front of the hook 18 a spaced distance rearwardly of the rear surface of the mounting bar 14, thereby creating a horizontal clearance therebetween in the area between the plates 20 and 22 for purposes to be described hereafter.

It will be noted that the upper mounting bar 14 of the side shifter frame 12 includes conventional spaced teeth to permit locking of the load-handling attachment (such as a pair of forks) in any of several alternative predetermined transverse positions. The lower mounting bar 16 of the side shifter frame includes stops 26 at the ends thereof for preventing the load-handling attachment from sliding outwardly off of the side shifter frame, and a removable stop 28 in the center of the bar 16 prevents the attachment from inadvertently sliding into the area of the lower cutout 29 through which the lower portion of the attachment is initially connected (with the stop 28 removed) to the lower mounting bar 16 during mounting of the attachment.

In order for the side shifter 10 to accomplish its function, the side shifter frame 12 upon which the load-handling attachment is mounted must be supported upon the upper and lower attachment mounting bars 30 and 32 respectively of the lift truck carriage in such a way that the side shifter frame 12 may be moved selectively in a transverse direction relative to the lift truck, that is, in a direction extending along the longitudinal dimension of the mounting bars 14 and 16. In addition, the side shifter frame 12 must be supported vertically on the lift truck carriage in such a way as to support the weight of the load and resist the downward moment (clockwise as seen in FIG. 2) imposed upon the side shifter frame and lift truck carriage by the weight of the load.

Selective transverse shifting of the side shifter frame 12 is accomplished by selective extension or retraction of the side shifter's double-acting hydraulic ram assembly 34 under the influence of a conventional operator-controlled hydraulic valve (not shown) which selectively directs fluid under pressure to one or the other of the hydraulic ports 36, 38 of the ram assembly 34 while simultaneously exhausting hydraulic fluid from the opposite port. The anchoring of the hydraulic ram assembly 34 so as to accomplish this function, and the structure by which the side shifter frame 12 is permitted to slide transversely with respect to the lift truck carriage, will now be discussed in detail.

To enable the quick-mounting of the side shifter 10 upon the lift truck carriage without the need for welding or other relatively permanent attachment of a hydraulic ram anchor to the carriage, the side shifter 10 is provided with an elongate rearwardly-facing quick-mounting anchor bracket 40. The structure of the anchor bracket 40 itself is best seen in FIG. 7 and comprises a plate having a downwardly-opening hook structure formed along its upper longitudinal edge 40*a*, such hook structure being formed so as to matingly engage the top of the upper attachment mounting bar 30 of the lift truck carriage. In the longitudinal center of the quick-mounting anchor bracket 40 a downwardly-depending lug structure 42 is welded into a slot formed in the hook of the anchor bracket so as to matingly engage the center notch of the upper attachment mounting bar 30 of the lift truck carriage. The downwardly-opening hook structure of the quick-mounting anchor bracket 40, together with the downwardly-depending lug 42, therefore enables the anchor bracket 40 to be detachably fixedly mounted atop the upper mounting bar 30 of the carriage such that transverse movement of the anchor bracket 40 relative to the mounting bar 30 is prevented.

The quick-mounting anchor bracket 40 has a pair of hydraulic ram anchors 44 and 46 fixedly mounted on the front face thereof, anchor 44 protruding upwardly above the upper longitudinal edge 40*a* of the anchor bracket and anchor 46 depending downwardly below the lower longitudinal edge 40*b* of the anchor bracket. The side shifter frame 12 has a pair of correspondingly-located hydraulic ram anchors comprising an upper anchor 48 and a lower anchor 50. As is best seen in FIG. 2, the lower pair of anchors 46 and 50 permit the ram assembly 34 to be mounted in a desirable lowered, substantially protected position between the upper and lower carriage mounting bars 30 and 32, and in a position wherein the ram assembly protrudes rearwardly beyond the rearwardly-facing surface 40*c* of the quick-mounting anchor bracket 40. This rearward protrusion of the ram assembly 34 minimizes the forward protrusion of the side shifter frame 12 which is extremely desirable in order to maximize the counterbalanced load-carrying capacity of the lift truck for reasons previously discussed. However, as also previously mentioned, in some lift trucks there may be insufficient space for placement of the hydraulic ram assembly 34 in the lowered position shown in FIG. 2. In such case, the installer has merely to utilize the alternative set of ram anchors 44 and 48 already provided on the side shifter so as to mount the ram assembly 34 in the alternative upper position shown in FIG. 2 above the upper longitudinal edge of the anchor bracket 40.

The slidable structure which vertically supports the side shifter frame 12 while permitting it to shift transversely with respect to the lift truck is provided by the sliding engagement of the elongate, downwardly-opening hook 18 of the side shifter frame 12 with the top of the quick-mounting anchor bracket 40. With reference to FIGS. 1 and 7, the quick-mounting anchor bracket 40 includes a pair of elongate friction-reducing nylon bushings 52 and 54 respectively mounted atop the upper edge of the anchor bracket. These bushings matingly and slidably engage the downwardly-opening inner surface of the elongate hook 18 as best seen in FIG. 4. It will be noted that the rear portion 18*a* of the inner surface of the hook 18 diverges downwardly from the remainder of the inner surface and that the rear surface of each bushing 52, 54 is inclined so as to match this angle of divergence. This readily permits the insertion of the upper edge 40*a* of the quick-mounting anchor bracket 40, together with its included bushings 52 and 54, into the downwardly-opening inner face of the hook 18. The only problem with such structure is that, when the side shifter is not mounted on a lift truck, the anchor bracket 40 with its bushings could easily drop out of engagement with the hook 18 causing disassembly of the side shifter and requiring reassembly prior to installation. In order to eliminate this problem, the upper ram anchor 44 which constitutes part of the anchor bracket 40 is provided with a rearwardly-protruding removable threaded stud 56 which horizontally overlaps the top of the hook 18 and thus prevents the anchor bracket 40 from dropping downwardly relative to the hook 18, without interfering with the desired transverse sliding motion of the hook 18 relative to the anchor bracket 40. Thus the stud 56 interlocks the side shifter frame 12 and quick-mounting anchor bracket 40 together to prevent disassembly thereof when the side shifter is not mounted on a lift truck carriage, and yet no removal of the interlocking stud 56 is required to permit the side shifter to operate properly when mounted on a lift truck. This is advantageous because the side shifter can be repeatedly mounted and demounted with no need to repeatedly install and remove the interlocking stud, which would otherwise require additional time and result in eventual loss of the removed part. Thus the interlocking stud can be inserted at the factory after assembly of the side shifter frame 12 and quick-mounting anchor bracket 40, with no need to tamper with it thereafter other than when disassembly of the side shifter is needed for repairs, for example to replace the bushings 52 and 54.

In this connection, it will now also be recognized why it is important that the plates 20 and 22 and spacer 24 provide a substantial horizontal clearance between the rear of the side shifter mounting bar 14 and the front of the hook 18. This clearance constitutes an effective elongate slot between the plates 20 and 22 through which the upper ram anchor 44 can protrude without interfering with the sliding motion of the side shifter frame 12 relative to the anchor bracket 40.

The inclined, downwardly-diverging inner surface of the hook 18 and the mating rear surface of the bushing 52 are preferably inclined at a somewhat steeper angle (approximately 5° steeper) than the rearwardly-inclined surface of the upper attachment mounting bar 30 of the lift truck carriage, so as to reduce the tendency toward upward displacement of the bushings 52 and 54 under the influence of the load moment imposed upon the hook 18. However this expedient does not positively prevent such upward displacement of the bushings. In order to actually provide positive prevention of such upward bushing displacement, it will be seen in FIG. 7 that the hook portion of the quick-mounting anchor bracket 40 has a pair of slots 58 formed at each end thereof, each of the slots including a downwardly-diverging opening in the rear side of the hook. Each bushing 52, 54 has a mating pair of downwardly-diverging retainer protrusions 60 on the underside thereof, as seen in FIG. 8, which fit matingly into the slots 58 and not only prevent transverse movement of the bushings relative to the anchor bracket 40 but also prevent upward movement of the bushings with respect to the anchor bracket.

Furthermore each of the protrusions 60 has a respective port 62 extending therethrough from front-to-rear adapted to receive a respective grease fitting 64 on the front thereof to permit the injection of grease through the port 62 into the bearing area between the bushing and the inner surface of the hook 18, as best seen in FIG. 4. Access to the grease fittings 64 is made possible by the frontal openings 58*a* in the respective slots 58, as seen in FIGS. 1 and 7.

Transversely-movable support for the bottom of the side shifter frame 12 is provided by a pair of spherical disc bearings 66 which rollingly and slidably abut the forward face of the lower attachment mounting bar 32 of the lift truck carriage. Each of these slider roller disc bearings 66 is mounted for rotation in a respective bearing mount 68 attached to the rear side of the attachment mounting bar 16 of the side shifter frame 12, and rotates about a forwardly and downwardly-tilted axis as described more fully in U.S. Pat. No. 4,165,008, hereby incorporated by reference. Each bearing mount 68 has a respective grease fitting 70 through which lubrication can be applied to the rear side of the disc bearing 66 through a series of radially-distributed lubrication channels 72.

Figure 3:
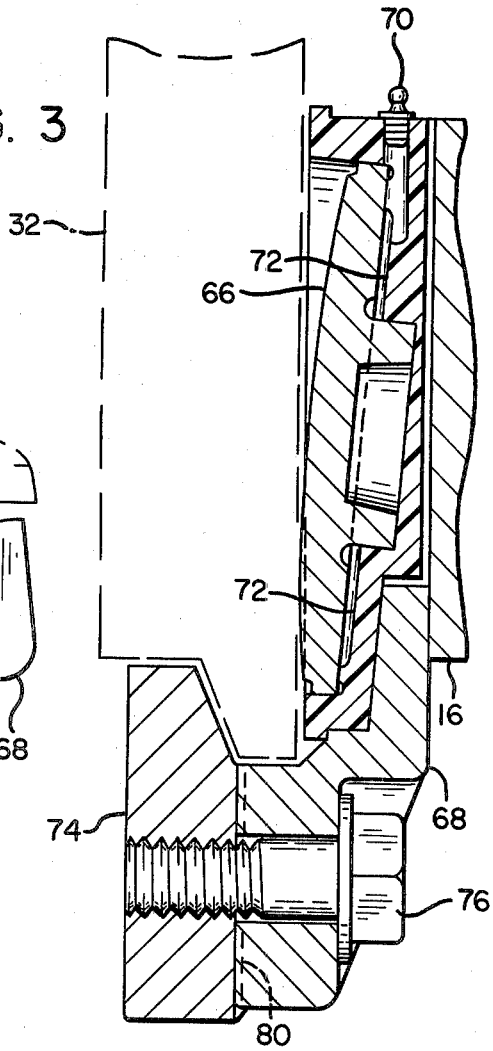
FIG. 3 is an enlarged cross-sectional view of the lower portion of the side shifter frame showing one of the canted slider roller bearings and lower hook assemblies used thereon, taken along line 3—3 of FIG. 1.
Figure 5:
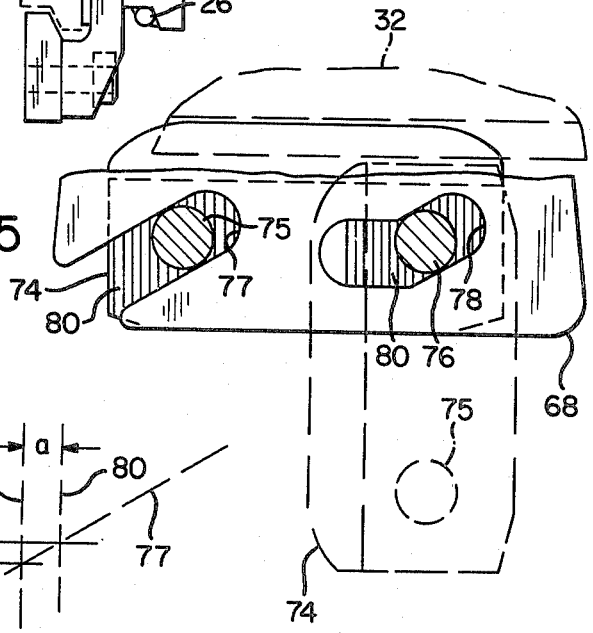
FIG. 5 is a partially-sectional front detail view of a lower hook assembly on the side shifter frame.

Each bearing mount 68 depends below the bottom of the lower attachment mounting bar 16 of the side shifter frame 12 so as to provide mountings for the respective upwardly-opening hooks 74 by which the bottom of the side shifter frame 12 slidably engages the lower attachment mounting bar 32 of the lift carriage, as seen in FIG. 3. The hook 74 is of elongate shape adapted to be held tightly in its engaged position by a pair of threaded bolts 75 and 76 which, when loosened, permit the hook 74 to be slid laterally in guide slots 77 and 78 (FIG. 5) until the bolt 75 is free of the open-ended guide slot 77, which thereby permits the hook 74 to swing downwardly into the depending position shown in phantom in FIG. 5. It will be noted that the downward protrusion of the elongate hook 74 below the bottom of the bearing mount 68 in the disengaged position of the hook is substantially greater than its upward protrusion above the bottom of the bearing mount 68 when in its engaged position. This permits the disengaged hook 74, in its downwardly-pivoted orientation, to serve as a means of supporting the side shifter frame 12 a spaced distance above the ground to permit easy demounting of the side shifter from the lift truck carriage by lowering the upper mounting bar 30 of the lift truck carriage out of engagement with the side shifter. To ensure stability, the remaining bolt 76 should be tightened to rigidify the downwardly-depending hook 74 for this purpose.

Figure 6:
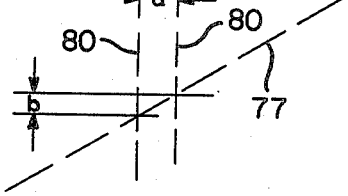
FIG. 6 is a schematic drawing illustrating the principle of incremental vertical adjustability of the lower hook assembly of FIG. 5.

Because the vertical adjustability of each hook 74 to within a small tolerance of the bottom of the mounting bar 32 of the lift truck carriage is important to ensure slidability while preventing disengagement, each hook 74 and its respective bearing mount 68 are provided with mating serrations 80 thereon for locking each hook 74 in any of various incremental adjustable positions. It will be noted that, although the desired adjustability is in a vertical direction, the serrations are not horizontally oriented but rather are vertically oriented. Such vertical orientation, in combination with the transversely-extending, upwardly-inclined guide slots 77 and 78, provides more fineness of vertical adjustability of the hook 74 than would be obtainable if the serrations were horizontally oriented. To illustrate this principle, the spacing of two vertical serrations 80 is illustrated by the two vertical lines in FIG. 6, and the inclination of the guide slots 77 is indicated by the inclined line 77. Accordingly, an incremental horizontal adjustment of the hook 74 by the distance "a" between the two adjacent serrations 80 actually produces an incremental vertical adjustment "b" which is substantially less than the increment "a" between the vertical serrations 80. If the inclination of the guide slots is, for example, at a 30° angle relative to horizontal, the incremental vertical adjustability of the hook 74 will be approximately one-half of the incremental horizontal adjustability provided by the serrations 80, thereby doubling the fineness of adjustability afforded by the serrations.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A side shifter, adapted for quick mounting upon the front of a vertically-movable lift truck carriage of the type having a transverse mounting member for load-handling attachments adjacent the top of the carriage, for mounting a load-handling attachment upon the carriage with the side shifter interposed structurally between the carriage and the attachment so that the attachment is transversely movable with respect to the carriage, and side shifter comprising:

(a) forwardly-facing mounting means for mounting a load-handling attachment thereon;

(b) rearwardly-facing mounting means interconnected with said forwardly-facing mounting means for detachably fixedly engaging said transverse mounting member of said carriage so as to prevent transverse movement between said rearwardly-facing mounting means and said transverse mounting member of said carriage, and for vertically supporting said forwardly-facing mounting means while permitting relative transverse motion between said forwardly-facing mounting means and said rearwardly-facing mounting means;

(c) a fluid ram interconnecting said forwardly-facing mounting means with said rearwardly-facing mounting means for selectively moving said forwardly-facing mounting means transversely with respect to said rearwardly-facing mounting means; and (d) fluid ram mounting means on said forwardly-facing mounting means and said rearwardly-facing mounting means respectively for enabling said fluid ram to be interconnected therebetween in either of two alternative, vertically-spaced positions located respectively above and below said transverse mounting member of said lift truck carriage.

2. The side shifter of claim 1 wherein said rearwardly-facing mounting means is of generally elongate shape having upper and lower longitudinal edges respectively, said fluid ram mounting means including means for enabling said fluid ram to be mounted in either of two alternative, vertically-spaced positions, one of said positions being located above said upper longitudinal edge of said rearwardly-facing mounting means and one of said positions being located below said lower edge of said rearwardly-facing mounting means.

3. The side shifter of claim 1 wherein said rearwardly-facing mounting means has a rearwardly-facing, generally vertically-oriented surface for abutting said transverse mounting member of said carriage, said fluid ram mounting means including means for enabling said fluid ram to be mounted such that at least a portion of said fluid ram protrudes rearwardly beyond said rearwardly-facing, generally vertically-oriented surface in either of said two alternative positions.

4. A side shifter, adapted for quick mounting upon the front of a vertically-movable lift truck carriage of the type having a transverse mounting member for load-handling attachments adjacent the top of the carriage, for mounting a load-handling attachment upon the carriage with the side shifter interposed structurally between the carriage and the attachment so that the attachment is transversely movable with respect to the carriage, said side shifter comprising:

(a) forwardly-facing mounting means for mounting a load-handling attachment thereon;

(b) rearwardly-facing mounting means interconnected with said forwardly-facing mounting means for detachably fixedly engaging said transverse mounting member of said carriage so as to prevent transverse movement between said rearwardly-facing mounting means and said transverse mounting member of said carriage, and for vertically supporting said forwardly-facing mounting means while permitting relative transverse motion between said forwardly-facing mounting means and said rearwardly-facing mounting means;

(c) said forwardly-facing mounting means including downwardly-opening hook means having an inner surface for engaging said rearwardly-facing mounting means and vertically supporting said forwardly-facing mounting means upon said rearwardly-facing mounting means while permitting relative transverse motion therebetween, said hook means having a rear portion of said inner surface which diverges downwardly from the remainder of said inner surface for matingly accepting the upward insertion of a portion of said rearwardly-facing mounting means into said hook means; and (d) interlocking means, located adjacent to said downwardly-opening hook means, interconnecting said forwardly-facing and rearwardly-facing mounting means respectively for permitting relative transverse motion therebetween while interacting operatively with said hook means to prevent said portion of said rearwardly-facing mounting means from being extracted downwardly from within said hook means.

5. The side shifter of claim 4 wherein said interlocking means comprises means movably mounted upon one of said respective mounting means so as to enable said interlocking means to be placed selectively in an inoperative position for permitting upward insertion of said portion of said rearwardly-facing mounting means into said hook means or, alternatively, in an operative position for preventing downward extraction of said portion of said rearwardly-facing mounting means from within said hook means.

6. The side shifter of claim 5 wherein said interlocking means is removably mounted upon said rearwardly-facing mounting means.

7. A side shifter, adapted for quick mounting upon the front of a vertically-movable lift truck carriage of the type having a transverse mounting member for load-handling attachments adjacent the top of the carriage, for mounting a load-handling attachment upon the carriage with the side shifter interposed structurally between the carriage and the attachment so that the attachment is transversely movable with respect to the carriage, said side shifter comprising:

(a) forwardly-facing mounting means for mounting a load-handling attachment thereon;

(b) rearwardly-facing mounting means interconnected with said forwardly-facing mounting means for detachably fixedly engaging said transverse mounting member of said carriage so as to prevent transverse movement between said rearwardly-facing mounting means and said transverse mounting member of said carriage, and for vertically supporting said forwardly-facing mounting means while permitting relative transverse motion between said forwardly-facing mounting means and said rearwardly-facing mounting means;

(c) said forwardly-facing mounting means having downwardly-opening hook means having an inner surface, a rear portion of which diverges downwardly from the remainder of said inner surface, for engaging a portion of said rearwardly-facing mounting means so as to vertically support said forwardly-facing mounting means upon said rearwardly-facing mounting means while permitting relative transverse motion therebetween;

(d) said rearwardly-facing mounting means including friction-reducing bushing means mounted upon said portion of said rearwardly-facing mounting means for transversely slidably engaging said downwardly-opening hook means; and (e) retainer means interconnecting said bushing means and said rearwardly-facing mounting means for preventing relative transverse motion therebetween while also preventing upward movement of said bushing means with respect to said rearwardly-facing mounting means.

8. The side shifter of claim 7 wherein said retainer means comprises means defining a downwardly-diverging opening on said rearwardly-facing mounting means and a mating, downwardly-diverging protrusion on said bushing means insertable into said opening.

9. A side shifter, adapted for quick mounting upon the front of a vertically-movable lift truck carriage of the type having an upper transverse mounting member for load-handling attachments adjacent the top of the carriage and a lower transverse mounting member adjacent the bottom of the carriage, for mounting a load-handling attachment upon the carriage with the side shifter interposed structurally between the carriage and the attachment so that the attachment is transversely movable with respect to the carriage, said side shifter comprising:

(a) forwardly-facing mounting means for mounting a load-handling attachment thereon;

(b) rearwardly-facing mounting means interconnected with said forwardly-facing mounting means for detachably fixedly engaging said upper transverse mounting member of said carriage so as to prevent transverse movement between said rearwardly-facing mounting means and said upper transverse mounting member of said carriage, and for vertically supporting said forwardly-facing mounting means while permitting relative transverse motion between said forwardly-facing mounting means and said rearwardly-facing mounting means;

(c) said forwardly-facing mounting means including upwardly-opening hook means for transversely slidably engaging said lower transverse mounting member of said carriage; and (d) connecting means movably mounting said upwardly-opening hook means on said forwardly-facing mounting means for selective movement of said hook means, without detachment of said hook means from said forwardly-facing mounting means and without detachment of said connecting means from said hook means, between a first position engaging said lower transverse mounting member of said carriage and extending above the bottom of said forwardly-facing mounting means by a first distance, and a second position depending downwardly below the bottom of said forwardly-facing mounting means by a second distance greater than said first distance so as to support said forwardly-facing mounting means above the ground by a space distance equal to said second distance.

10. A side shifter, adapted for mounting upon the front of a vertically-movable lift truck carriage of the type having an upper transverse mounting member for load-handling attachments adjacent the top of the carriage and a lower transverse mounting member adjacent the bottom of the carriage, for mounting a load-handling attachment upon the carriage with the side shifter interposed structurally between the carriage and the attachment so that the attachment is transversely movable with respect to the carriage, said side shifter comprising:

(a) forwardly-facing mounting means for mounting a load-handling attachment thereon;

(b) rearwardly-facing mounting means interconnected with said forwardly-facing mounting means for engaging said upper transverse mounting member of said carriage and for vertically supporting said forwardly-facing mounting means while permitting relative transverse motion between said forwardly-facing mounting means and said upper transverse mounting member of said carriage;

(c) said forwardly-facing mounting means including upwardly-opening hook means for transversely slidably engaging said lower transverse mounting member of said carriage;

(d) said upwardly-opening hook means being movably mounted for vertical adjustment with respect to said forwardly-facing mounting means, said upwardly-opening hook means and forwardly-facing mounting means respectively having mating, substantially vertically-oriented serrations thereon and said forwardly-facing mounting means having transversely-extending guide means inclined with respect to said vertical serrations for guiding said upwardly-opening hook means in a direction inclined with respect to said vertically-oriented serrations during vertical adjustment of said upwardly-opening hook means.

* * * * *